US006164111A

United States Patent [19]

Langeder

[11] Patent Number: 6,164,111

[45] Date of Patent: Dec. 26, 2000

[54] BENDING DEVICE FOR TWO WORKING ROLLS OF A ROLL STAND

[75] Inventor: Rudolf Langeder, Mauthausen, Austria

[73] Assignee: Voest-Alpine Indstrieanlagenbau GmbH, Austria

[21] Appl. No.: 09/420,171

[22] Filed: Oct. 18, 1999

[30] Foreign Application Priority Data

Oct. 19, 1998 [AT] Austria ..... 1742/98

[51] Int. Cl.[7] ..... B21B 13/14; B21B 31/07

[52] U.S. Cl. ..... 72/241.8

[58] Field of Search ..... 72/341.8, 241.4, 72/241.6

[56] References Cited

U.S. PATENT DOCUMENTS

| | | | |
|---|---|---|---|
| 4,627,261 | 12/1986 | Schiller | 72/241.8 |
| 5,239,851 | 8/1993 | Takakura et al. | 72/241.8 |
| 5,638,716 | 6/1997 | Jonen | 72/241.8 |

FOREIGN PATENT DOCUMENTS 0256408 2/1988 European Pat. Off. .

*Primary Examiner*—Rodney A. Butler
*Attorney, Agent, or Firm*—Ostrolenk, Faber, Gerb & Soffen, LLP

[57] ABSTRACT

A description is given of a bending device for two working rolls (1) of a roll stand having guide blocks (6), provided in lateral roll uprights (3), for each of two vertically adjustable pressure transmission elements (4*a*, 4*b*), on which the working rolls (1) are supported via inserts (2), and each having two bending cylinders (5), which are arranged between the pressure transmission elements (4*a*, 4*b*) and have a piston rod (12) which acts on a pressure transmission elements (4*b*, 4*a*), and a cylinder (10) formed by the respective other pressure transmission element (4*b*, 4*a*). In order to provide advantageous design conditions, it is proposed that the L-shaped pressure transmission elements (4*a*, 4*b*) have a longer, vertical and a shorter, horizontal limb (8, 9), that the limbs (8, 9) of the pressure transmission elements (4*a*, 4*b*) be located opposite each other in pairs in a plane parallel to the working rolls (1), and that the longer limbs (8) of the pressure transmission elements (4*a*, 4*b*) be mounted in vertical guides (7) in the respective guide block (6) and accommodate a cylinder (10) of the bending cylinders (5), whose piston rods (12) act on the shorter limbs (9) of the respective other pressure transmission element (4*b*, 4*a*).

10 Claims, 3 Drawing Sheets

BENDING DEVICE FOR TWO WORKING ROLLS OF A ROLL STAND

Figure 1:
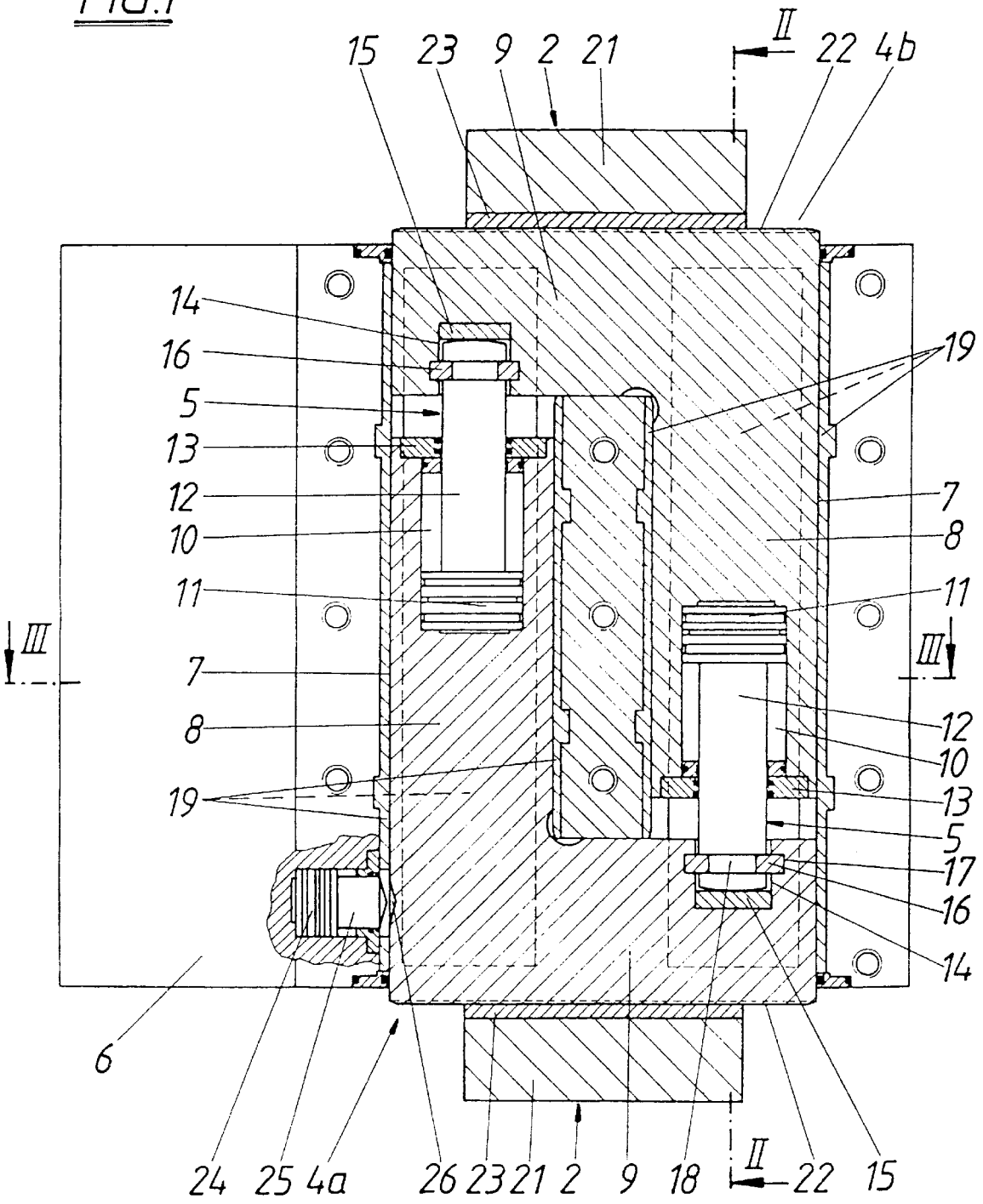

The invention relates to a bending device for two working rolls of a roll stand having guide blocks, provided in lateral roll uprights, for each of two vertically adjustable pressure transmission elements, on which the working rolls are supported via inserts, and each having two bending cylinders, which are arranged between the pressure transmission elements and have a piston rod which acts on a pressure transmission element, and a cylinder formed by the respective other pressure transmission element.

In order to obtain an operationally reliable bending device for axially displaceable working rolls of a roll stand, it is known (EP 0 256 408 A2) to support the inserts which accommodate the bearings for the working rolls each via a sliding surface, arranged in the vertically central region, on a guide attachment of pressure transmission elements which are arranged in pairs and which can be pressed apart in the vertical direction via two bending cylinders which are in each case arranged between them. In order to guide the pressure transmission elements, the guide blocks form lateral guide webs around which the pressure transmission elements engage. In order to extend the guide length of the pressure transmission elements which can be achieved with said guide webs, the respective lower pressure transmission elements additionally bear a central guide limb, which projects into the region of the respective upper pressure transmission element and engages into a guide groove in the guide block between the two guide webs. The upper pressure transmission elements, which form a holding recess for the guide limb of the associated lower pressure transmission element, have a guide pin which, for additional guidance, projects towards the lower pressure transmission element and into a guide bush in the lower pressure transmission element. The bending cylinders are provided symmetrically in relation to the guide pin, the arrangement being made in such a way that the upper pressure transmission elements form the cylinder, while the piston rods are supported in holding recesses in the lower pressure transmission elements. Since the bending cylinders are provided between the mutually associated pressure transmission elements, and are not supported in the guide block which is fixed to the upright, it is possible for bending stress on the guide blocks and hence on the roll uprights to be avoided, said stress being caused by the bending loading of the working rolls. However, the disadvantage is that, in order to ensure an advantageous guide length for the pressure transmission elements, a comparatively complicated design is necessary, since the pressure transmission elements have to be guided not only in the respective guide block but also in relation to one another.

The invention is thus based on the object of configuring a bending device for the working rolls of a roll stand of the type outlined at the beginning in such a way that a relatively uncomplicated design becomes possible, which is also advantageously able to meet high requirements relating to the guidance of the pressure transmission elements.

The invention achieves the object set in that the L-shaped pressure transmission elements have a longer, vertical and a shorter, horizontal limb, in that the limbs of the pressure transmission elements are located opposite each other in pairs in a plane parallel to the working rolls, and in that the longer limbs of the pressure transmission elements are mounted in vertical guides in the respective guide block and accommodate a cylinder of the bending cylinder, whose piston rods act on the shorter limbs of the respective other pressure transmission element.

As a result of the L-shape of the pressure transmission elements, whose limbs are arranged opposite each other in pairs, a simple, rugged construction is obtained which, because of the guidance of the longer, vertical limbs of the pressure transmission elements, permits an advantageous guide length for the pressure transmission elements. For this purpose, the guide blocks only need to form two parallel vertical guides for the longer limbs of the pressure transmission elements, which allows symmetrical guide conditions for the interacting pressure transmission elements. Since, in addition, the longer limbs of the pressure transmission elements offer sufficient space to form a cylinder in the limb, the result is a compact arrangement with the additional advantage that the pressure transmission elements can be shaped identically, both for the upper and for the lower working roll. The advantageous mounting of the longer limbs of the pressure transmission elements in a vertical guide with a closed circumference is made easier by the fact that the inserts of the working rolls are not supported on guide attachments in the vertically central region of the pressure transmission elements, but on the outer faces of the horizontal limbs of the pressure transmission elements, which limbs project vertically beyond the guide blocks. Because the guides of the vertical limbs of the pressure transmission elements are located beside one another, the result is that the overall height is not increased by comparison with conventional bending devices, which certainly, because of the vertical guides for the pressure transmission elements running one behind another in the direction of the displacement, require a central guide attachment in order to support the inserts.

Supporting the inserts of the working rolls on the outer faces of the horizontal limbs of the pressure transmission elements permits a comparatively large supporting region for the inserts. Angular errors and bending movements can be taken into account by a spherical curvature of the outer face of the horizontal limbs of the pressure transmission elements transversely to the longitudinal direction of the limbs.

For the purpose of the simple axial locking of the piston rods of the bending cylinders to the horizontal limbs of the pressure transmission elements, the piston rods can be fixed axially in holding bores in the horizontal limbs with the aid of locking bolts which can be inserted into the holding bores transversely with respect to the piston rods. This provides simple assembly, since it is only necessary for the locking bolts to be inserted into corresponding guides in the holding bores.

In order that a working-roll change can be performed in a simple way, it must be possible for the respective lower pressure transmission element to be fixed with respect to the guide block in such a way that this pressure transmission element cannot be displaced downwards when the support via the lower working roll is removed. For this reason, the pressure transmission elements for the lower working roll can in each case be locked against displacement downwards with respect to the associated guide blocks, so that the entire stroke of the bending cylinders can advantageously be utilized for the working-roll change.

Figure 2:
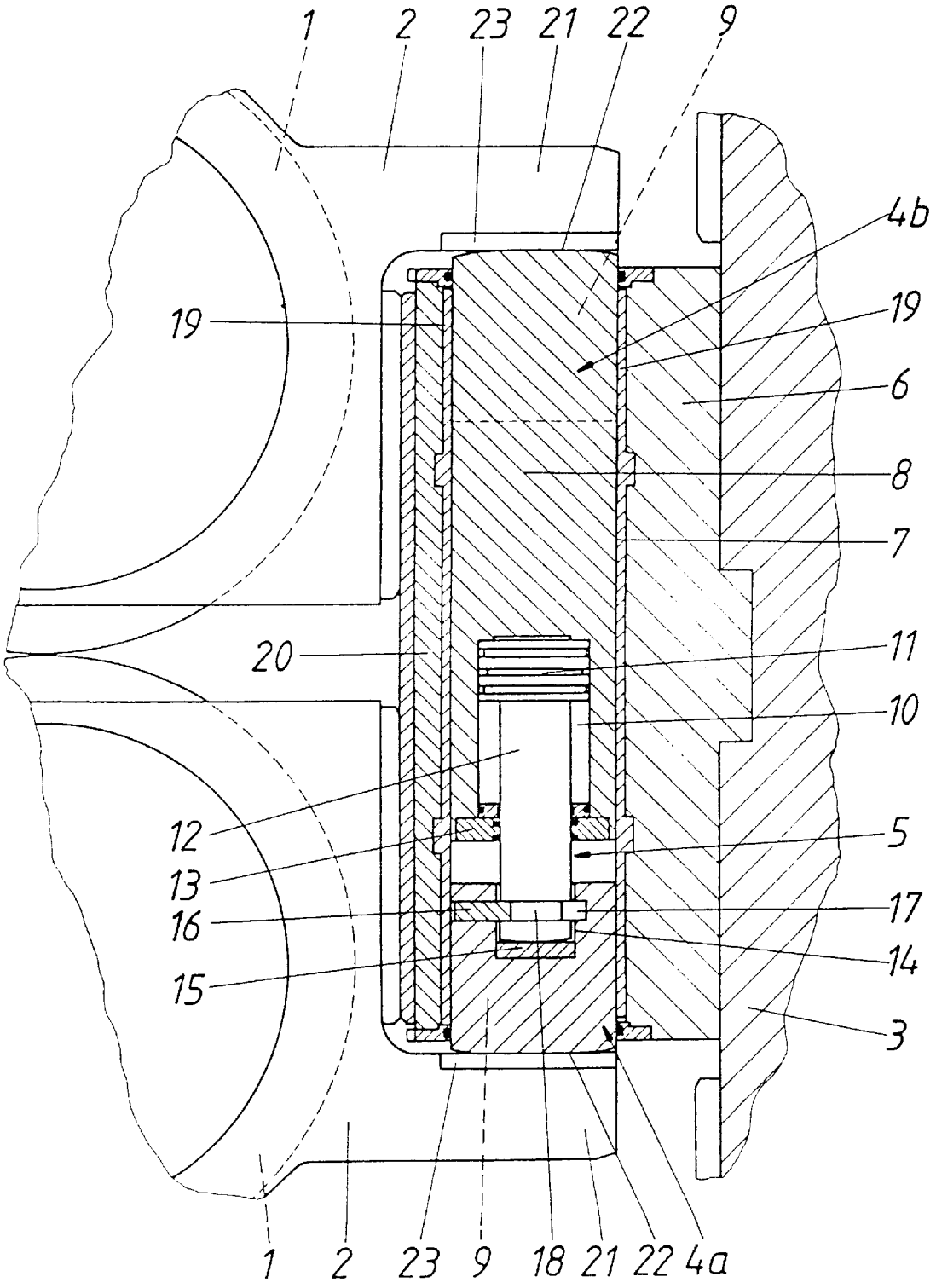
Figure 3:
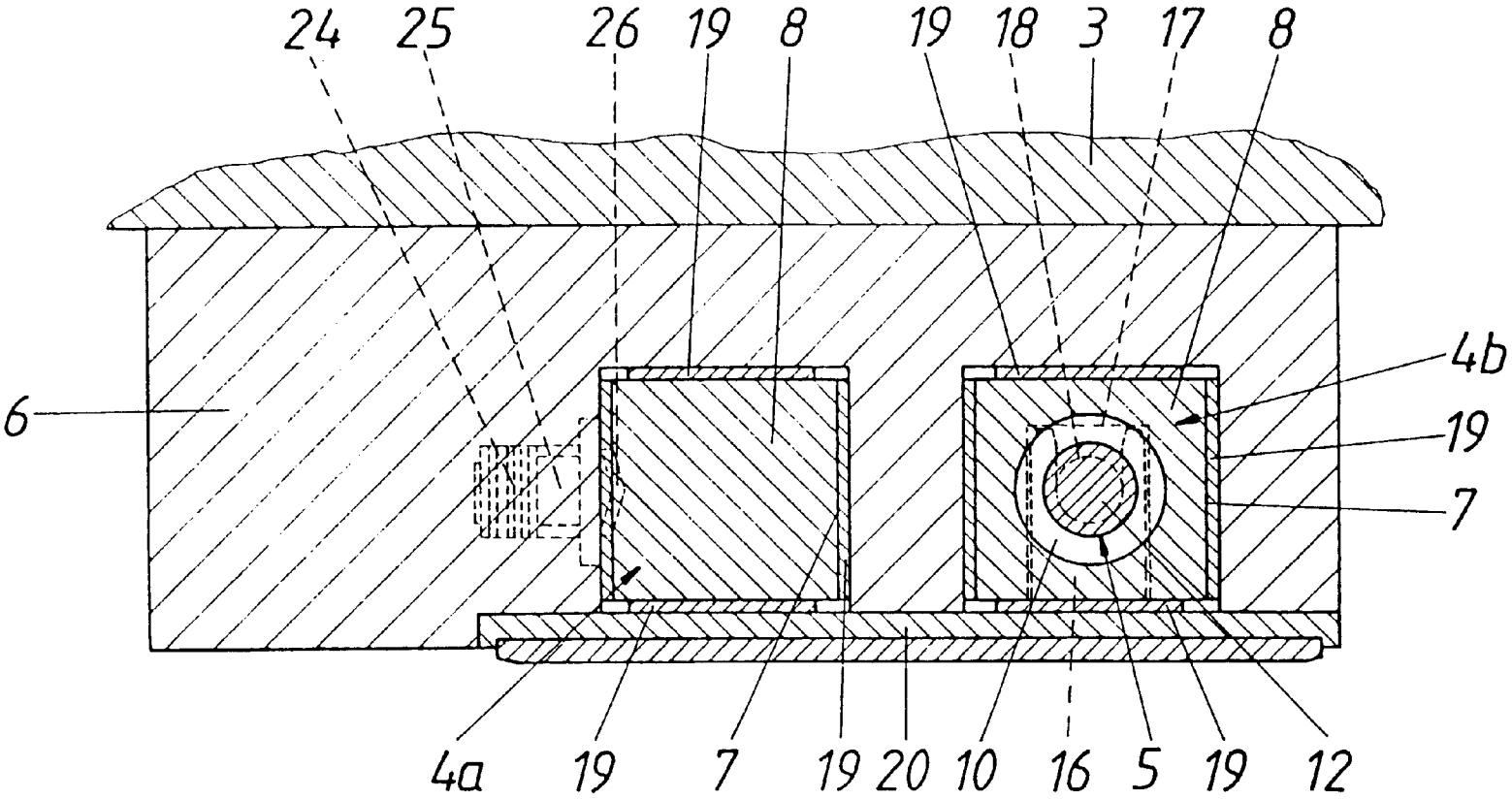

The subject-matter of the invention is illustrated by way of example in the drawing, in which:

FIG. 1 shows a detail of a bending device according to the invention in a section through the pressure transmission elements parallel to the working rolls, FIG. 2 shows this bending device in a section along the line II—II in FIG. 1, and FIG. 3 shows a section along the line III—III in FIG. 1.

The working rolls 1 of a roll stand (not illustrated in more detail) are mounted at the ends in inserts 2, which can be adjusted vertically in the window in the lateral roll uprights 3, in order, by means of this vertical adjustment, to influence the bending of the working rolls 1, in particular in conjunction with an axial displacement of the working rolls 1 with respect to their supporting rolls. The adjustment of the working rolls 1 in opposite directions is carried out with the aid of a bending device which essentially comprises pressure transmission elements 4*a*, 4*b* which are arranged in pairs and between which bending cylinders 5 are arranged. The pressure transmission elements 4*a*, 4*b*, which are provided in pairs on either side of the inserts 2, are each vertically displaceably mounted in a guide block 6. As can be seen, in particular, from FIG. 2, the guide blocks 6 are fastened laterally in the window in the roll upright 3 and form two parallel vertical guides 7 for the pressure transmission elements 4*a*, 4*b*, which have an L-shape with a longer, vertical limb 8 and a shorter, horizontal limb 9. The arrangement in this case is made in such a way that the limbs 8 and 9 of the pressure transmission elements 4*a* and 4*b* are located opposite each other in pairs, as FIG. 1 reveals. The limbs 8 and 9 of the pressure transmission elements 4*a* and 4*b* are provided with a rectangular, preferably square, cross section and are located in a common mid-plane which is parallel to the common diametrical plane of the working rolls 1. The cylinders 10 of the bending cylinders 5 can therefore be formed in a simple way by the vertical limbs 8 of the pressure transmission elements 4*a* and 4*b*. The piston rod 12, provided with a piston 11, of the bending cylinder 5 passes through a cylinder cover 13 and engages in a holding recess 14 in the horizontal limb 9 of the respective other pressure transmission element 4*b* or 4*a*. In order to transmit the bending forces, use is made of a pressure piece 15 inserted into the holding recess 14. The high-tensile anchorage of the piston rods 12 in the holding recess 14 is carried out via U-shaped locking bolts 16, which engage in a slot guide 17 in the horizontal limb 9, perpendicular to the piston rod 12, which is enclosed by the locking bolt 16 in an annular groove 18.

The vertical guides 7 for the limbs 8 of the pressure transmission elements 4*a* and 4*b* are provided with sliding plates 19, in order to ensure advantageous frictional conditions. As FIGS. 2 and 3 show, the vertical guides 7 are closed, on the side facing the working rolls 1, by a cover 20, which bears the associated sliding plates 19. When the cover 20 is removed, therefore, it is possible for the pressure transmission elements 4*a* and 4*b* to be inserted in a simple way into the vertical guides 7.

According to FIGS. 1 and 2, the inserts 2 of the working rolls 1 are supported, via supporting extensions 21, on the outer faces 22 of the horizontal limbs 9 of the pressure transmission elements 4*a* and 4*b*, to be specific via sliding plates 23, which facilitate the axial displacement of the inserts 2 with respect to the pressure transmission elements 4. In addition, the outer faces 22 of the horizontal limbs 9 of the pressure transmission elements are designed to be spherically curved transversely to the longitudinal direction of the limbs, so that tilting movements of the supporting extensions 21 with respect to the pressure transmission elements cannot lead to any contact errors.

In order to be able to exert corresponding bending forces on the working rolls 1 via the inserts 2, the pistons 11 of the bending cylinders 5 are loaded hydraulically, as a result of which the pressure transmission elements 4*a* and 4*b* are pressed apart from one another in the vertical direction. Since the pressure transmission elements 4*a* and 4*b* are only supported with respect to one another via the bending cylinders 5, but are not supported in the vertical direction with respect to the guide blocks 6, the guide blocks 6 remain largely free of these bending forces. Although this floating mounting of the pressure transmission elements 4*a* and 4*b* permits the advantageous transmission of the bending forces to the inserts 2, this floating mounting prevents the bending cylinders 5 being used for a working-roll change, since for this purpose the respective lower pressure transmission element 4*a* has to be secure against moving downwards beyond a predefined basic position. For this reason, the lower pressure transmission element 4*a* is provided with a locking means in this basic position. The locking means is formed by an actuating drive 24 which is mounted in the respective guide block 6 and which acts on a locking piece 25, which engages in a corresponding latching recess 26 in the lower pressure transmission element 4*a*. The actuating drive 24 preferably comprises a hydraulic actuating cylinder, whose piston rod forms the locking piece 25. If the lower pressure transmission element 4*a* is locked to the associated guide block 6 by the locking piece 25, the upper pressure transmission element 4*b* can be lifted via the bending cylinders 5, in order for a simple working-roll change to be carried out.

What is claimed is:

1. Bending device for two working rolls of a roll stand having guide blocks, provided in lateral roll uprights, for each of two vertically adjustable pressure transmission elements, on which the working rolls are supported via inserts, and each having two bending cylinders, which are arranged between the pressure transmission elements and have a piston rod which acts on a pressure transmission element, and a cylinder formed by the respective other pressure transmission element, characterized in that the L-shaped pressure transmission elements (4*a*, 4*b*) have a longer, vertical and a shorter, horizontal limb (8, 9), in that the limbs (8, 9) of the pressure transmission elements (4*a*, 4*b*) are located opposite each other in pairs in a plane parallel to the working rolls (1), and in that the longer limbs (8) of the pressure transmission elements (4*a*, 4*b*) are mounted in vertical guides (7) in the respective guide block (6) and accommodate a cylinder (10) of the bending cylinders (5), whose piston rods (12) act on the shorter limbs (9) of the respective other pressure transmission element (4*b*, 4*a*).

2. Bending device according to claim 1, characterized in that the inserts (2) of the working rolls are supported on an outer face (22) of the horizontal limbs (9) of the pressure transmission elements (4*a*, 4*b*), which limbs project vertically beyond the guide blocks (6).

3. Bending device according to claim 1, characterized in that the piston rods (12) of the bending cylinders (5) are fixed axially in holding bores (14) in the horizontal limbs (9) of the pressure transmission elements (4*a*, 4*b*) with the aid of locking bolts (16) which are inserted into the holding bores (14) transversely with respect to the piston rods (12).

4. Bending device according to claim 1, characterized in that in each case the pressure transmission elements (4*a*) for the lower working roll (1) are locked against displacement downwards with respect to the associated guide blocks (6).

5. Bending device according to claim 2, characterized in that the outer face (22) of the horizontal limbs (9) of the pressure transmission elements (4*a*, 4*b*) are designed to be spherically curved transversely to the longitudinal direction of the limbs.

6. Bending device according to claim 2, characterized in that the piston rods of the bending cylinders are fixed axially in holding bores in the horizontal limbs of the pressure transmission elements with the aid of locking bolts which are inserted into the holding bores transversely with respect to the piston rods.

7. Bending device according to claim 2, characterized in that the piston rods of the bending cylinders are fixed axially in holding bores in the horizontal limbs of the pressure transmission elements with the aid of locking bolts which are inserted into the holding bores transversely with respect to the piston rods.

8. Bending device according to claim 5, characterized in that the piston rods of the bending cylinders are fixed axially in holding bores in the horizontal limbs of the pressure transmission elements with the aid of locking bolts which are inserted into the holding bores transversely with respect to the piston rods.

9. Bending device according to claim 5, characterized in that the piston rods of the bending cylinders are fixed axially in holding bores in the horizontal limbs of the pressure transmission elements with the aid of locking bolts which are inserted into the holding bores transversely with respect to the piston rods.

10. Bending device according to claim 3, characterized in that the piston rods of the bending cylinders are fixed axially in holding bores in the horizontal limbs of the pressure transmission elements with the aid of locking bolts which are inserted into the holding bores transversely with respect to the piston rods.

* * * * *

UNITED STATES PATENT AND TRADEMARK OFFICE

CERTIFICATE OF CORRECTION

PATENT NO. : 6,164,111

DATED : December 26, 2000

INVENTOR(S) : Langeder

It is certified that error appears in the above-identified patent and that said Letters Patent is hereby corrected as shown below:

[73] Assignee: Voest-Alpine Industrieanlagenbau GmbH, Austria

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*